US006457430B1

(12) United States Patent
Drabkin

(10) Patent No.: US 6,457,430 B1
(45) Date of Patent: Oct. 1, 2002

(54) SAILING ASSEMBLY FOR SMALL BOATS

(76) Inventor: David Drabkin, 30937 Baileys La., Big Pine Key, FL (US) 33043

( * ) Notice: Subject to any disclaimer, the term of this patent is extended or adjusted under 35 U.S.C. 154(b) by 0 days.

(21) Appl. No.: 09/892,392

(22) Filed: Jun. 27, 2001

(51) Int. Cl.[7] ..... B63B 35/00
(52) U.S. Cl. ..... 114/39.22; 114/90; 114/91
(58) Field of Search ..... 114/39.22, 90, 114/91

(56) References Cited

U.S. PATENT DOCUMENTS

| | | | | | |
|---|---|---|---|---|---|
| 1,916,459 | A | | 7/1933 | Blackman | |
| 3,041,994 | A | * | 7/1962 | Brodie | 114/39.22 |
| 3,777,690 | A | * | 12/1973 | Garber | 114/39.22 |
| 3,827,386 | A | | 8/1974 | Faden | |
| 3,902,443 | A | * | 9/1975 | McDougall | 114/39.22 |
| 4,112,861 | A | | 9/1978 | Lewis | |
| 4,194,458 | A | * | 3/1980 | Messing | 114/90 |
| 4,259,917 | A | | 4/1981 | Frank | |
| 4,273,062 | A | | 6/1981 | Marker | |
| 4,528,926 | A | | 7/1985 | Brockhaus | |
| 4,646,669 | A | * | 3/1987 | Frank | 114/39.22 |
| 4,655,154 | A | * | 4/1987 | Leonard | 114/91 |
| 4,751,889 | A | * | 6/1988 | Pool | 114/90 |
| 5,188,050 | A | * | 2/1993 | Latham | 114/90 |
| 6,240,865 | B1 | * | 6/2001 | Hubbard | 114/39.28 |

* cited by examiner

*Primary Examiner*—S. Joseph Morano
*Assistant Examiner*—Lars A Olson
(74) *Attorney, Agent, or Firm*—Alvin S. Blum

(57) ABSTRACT

Small boats such as kayaks, canoes, and skiffs that are normally not propelled by wind power are provided with apparatus of this invention that can enable the conversion to a sailing vessel. A mast is movable from a horizontal inoperative position to an erect operable position. Lee boards are movable from a raised inoperative position to a lowered operative position. Sails are movable from a lowered operative position to a raised inoperative position. Movement between operative and inoperative positions of the sailing elements are all operable by the boater from the boater's normal position. The boater may thereby convert from a non-sailing to a sailing vessel or the reverse with a minimum of effort, time, and inconvenience. The vessel may be paddled with the mast up if desired.

19 Claims, 8 Drawing Sheets

SAILING ASSEMBLY FOR SMALL BOATS

This invention relates to sailboats and more particularly to apparatus for providing the means to enable a small boat such as a kayak that is normally propelled by other means to be optionally propelled by wind power.

BACKGROUND OF THE INVENTION

Kayaks are normally propelled by paddles. They are light in weight to be easily transportable. They have a low center of gravity and low vertical clearance to enhance their adaptability to various boating conditions. There are situations where it would be desirable to have a sail attached for wind propulsion. It would be awkward to have the mast and sail in position for most of the time when using a small boat such as a kayak, or when transporting it.

SUMMARY OF THE INVENTION

It is accordingly an object of the invention to provide a means for attaching a sail to a small boat such as a kayak, a canoe, or a skiff. It is another object that the device be easily removed for transport or for non-sail use. It is another object to provide a mast and sail that may be erected and deployed for use by a boater without requiring the boater to move from the usual boater position. It is yet another object that the sail and mast may be lowered out of the way for ordinary non-sail use without requiring the boater to move from the usual boater position. The boater may thus enjoy boating without interference from the mast or sail as desired, including paddling the vessel while in the sailing mode.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
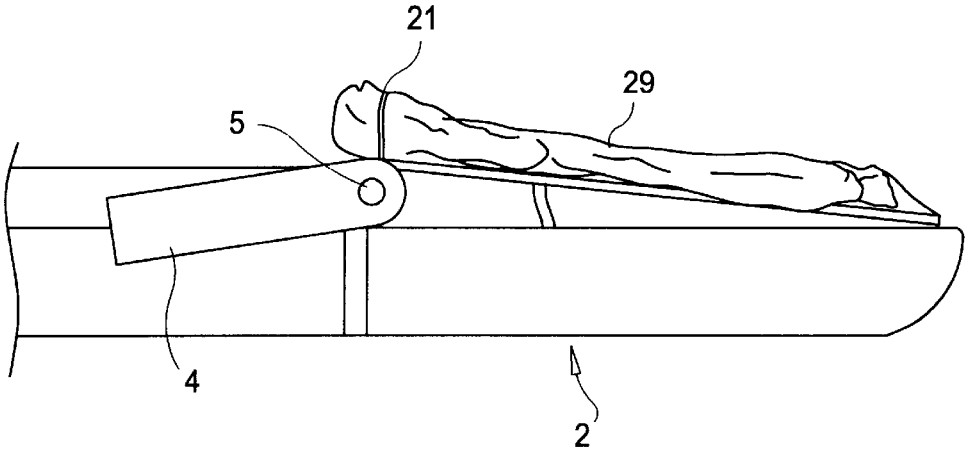
FIG. 1 is a perspective view of the assembly of the invention mounted on a kayak with the mast lowered.
Figure 2:
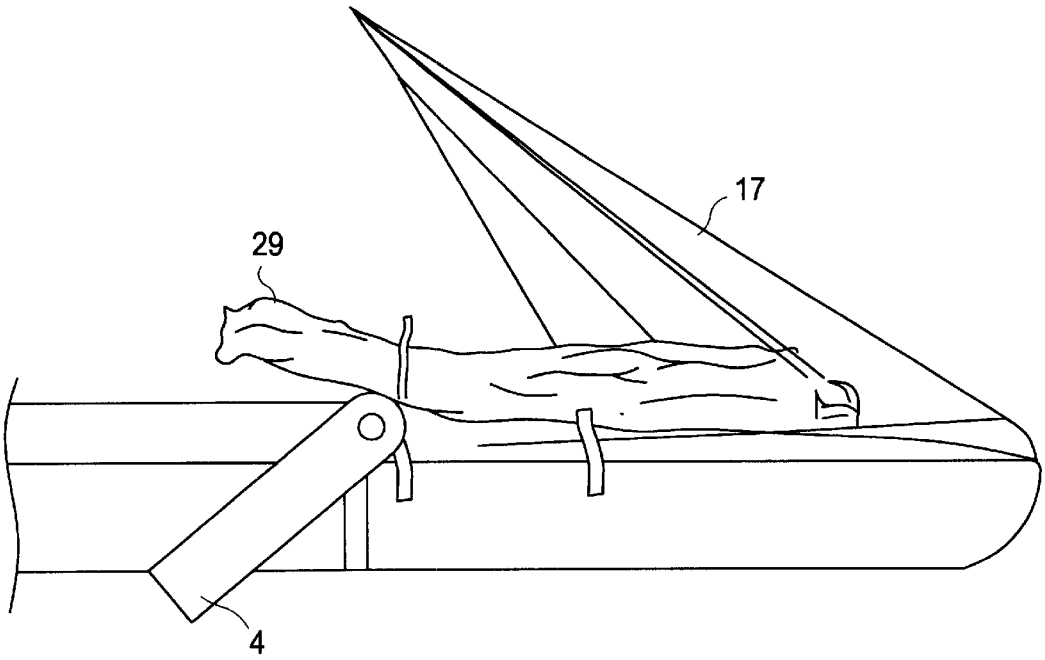
FIG. 2 is a perspective view of the assembly of the invention mounted on a kayak with the mast partially erected.
Figure 3:
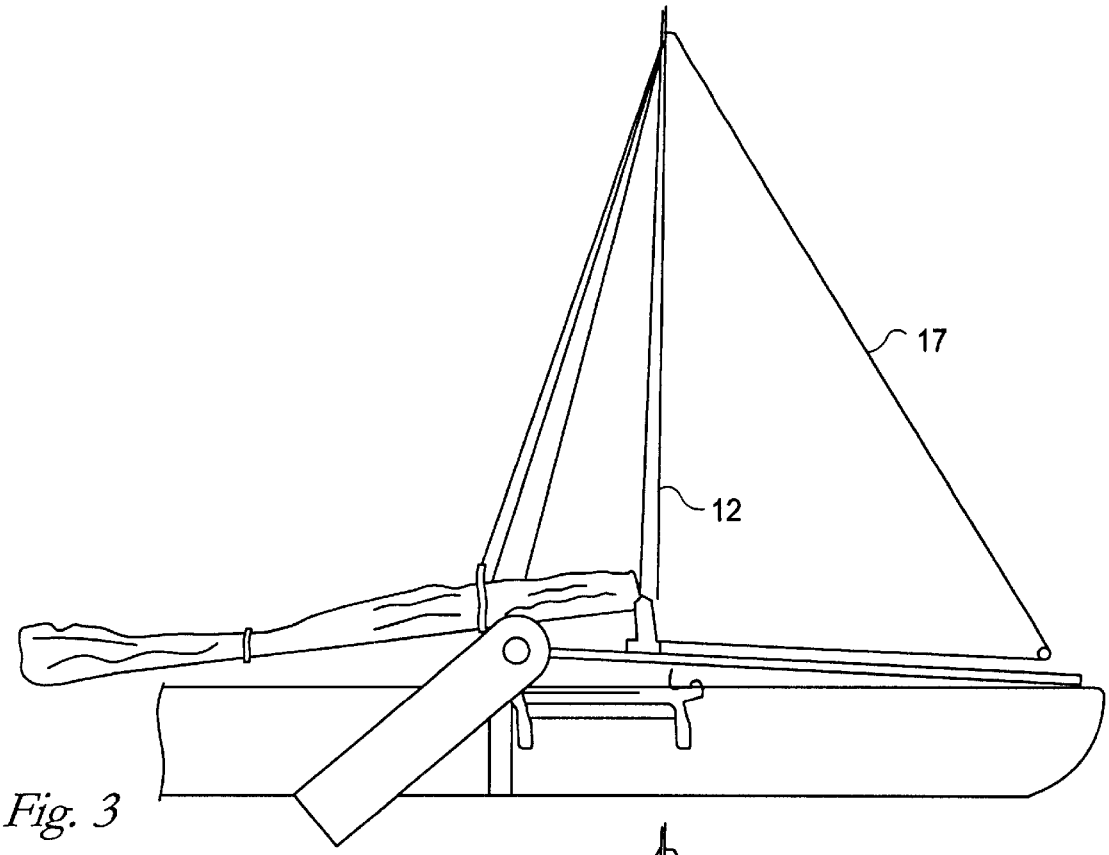
FIG. 3 is a perspective view of the assembly of the invention mounted on a kayak with the mast erect.
Figure 4:
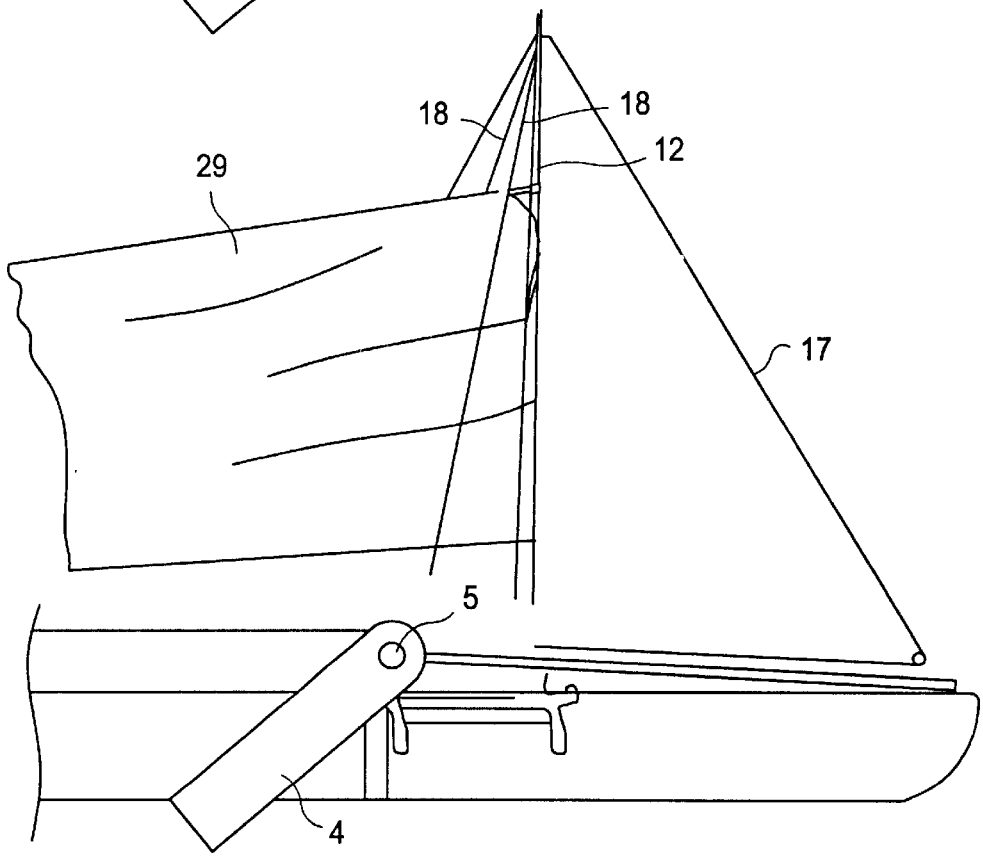
FIG. 4 is a perspective view of the assembly of the invention mounted on a kayak with the mast erect and the sails partially raised.
Figure 5:
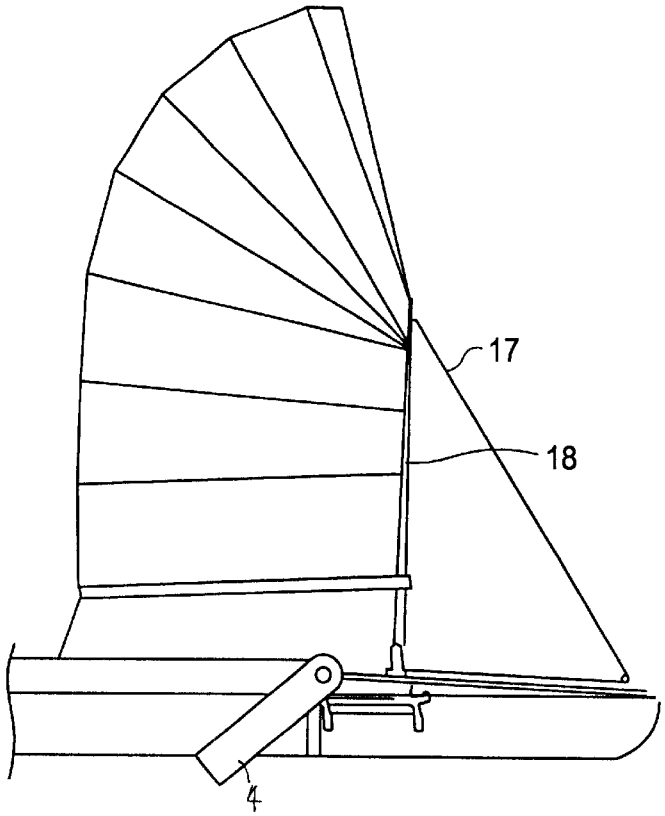
FIG. 5 is a perspective view of the assembly of the invention mounted on a kayak with the mast erect and the sails fully raised.
Figure 6:
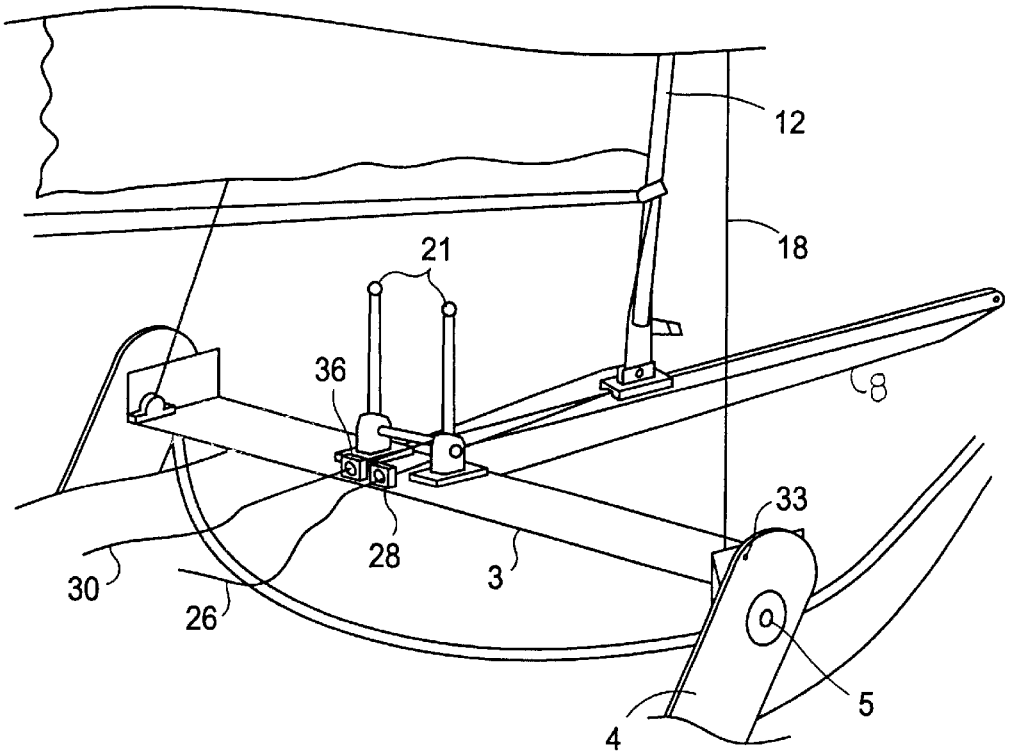
FIG. 6 is a detail perspective view of the control area of the device, with mast and sail up.

Referring now to the drawing FIGS. 1–10, and 16, the assembly 1 of the invention comprises a base 3 adapted for attachment to the upper deck of the kayak 2. The assembly 1 may be removably attached to the kayak 2 so that it may be readily removed for transport, and the like. Alternatively, it may be permanently attached to the boat. Alternatively, the base may comprise the upper molded deck of the kayak (not shown). The base has lee boards 4 pivotally attached thereto at pivots 5 that are adapted to extend down into the water enough to overcome lateral forces when in sailing mode and to rotate upward to retract from the down position when not in the sailing mode. Cords 33 enable the boater to retract the lee boards from the boater's position. The lee boards may be raised or lowered by a torsion spring or other spring bias means or by another cord operable from the boater's position.

A guideway 8 in the upper surface of the base is aligned with a centerline 7 of the boat. A guideway follower means, or rider 9, is held in the guideway and slides freely between a forward stop position 10 and an aft position stop 11. A mast lowering cord 22 has a first end 23 connected to the front end of rider 9. A second end of cord 22 is provided with spring bias to pull the rider to the forward position 10. The spring bias may be, for example, but not limited to, an extension spring, or, as shown here, the cord 22 may be an elastic cord. Mast 12 is attached at pivot 16 to the rider 9. Mast deploying cord 26 is attached to the back end of rider 9 for pulling the rider back to the aft position 11. The cord 26 passes through a pulley/cleat 28 and then to the boater position so that the movement can be performed by the boater at that location. Forestay 17 and side stays 18 are attached at one end to the upper portion 15 of the mast. The second ends of the stays are attached to the base. When the rider is pulled to the aft position 11, the forestay pulls on the upper portion of the mast, causing the mast to rise to a vertical position. The mast is held securely when vertical by the forestay forward of the rider at the centerline and the side stays on the base abaft the rider to form a triangular support base. Elevation means 21 holds the forestay up above the mast when the mast is in the horizontal position. This enhances the ability of the forestay to raise the mast. When the cord 26 is released, the rider 9 is pulled to the forward position 10 by the mast lowering cord 22, and the mast is pulled down to a horizontal position. Stay-tensioning shock cords 34 pull on the stays and maintain tension thereon at all times.

A sail 29 rides up and down on the mast under the control of halyard 30. The halyard passes through pulley/cleat 36 to the boater position so that the sail may be raised or lowered from the boater position. The sail and its sliding attachment to the mast and halyard may be any of those well known in the art. Means 31 are provided for securing the lowered sail and mast to the base so that they don't interfere with other use of the boat.

Figure 7:
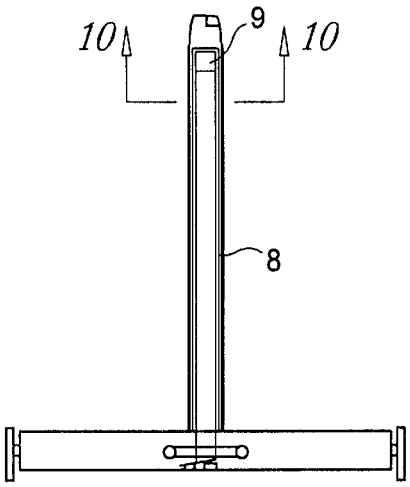
FIG. 7 is a diagrammatic top view of the device of the invention, without the sail, in mast down position.
Figure 8:
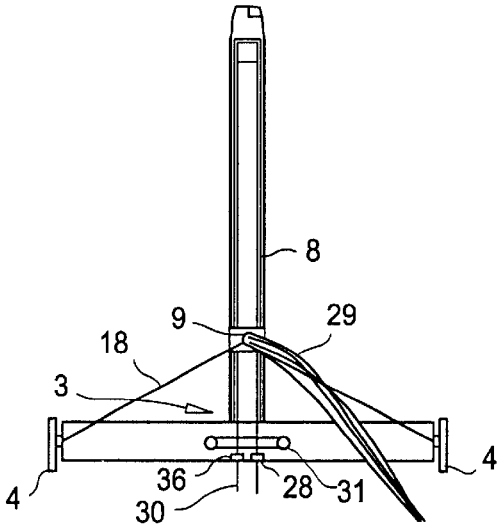
FIG. 8 is a top view as in FIG. 7, in mast up position.
Figure 9:
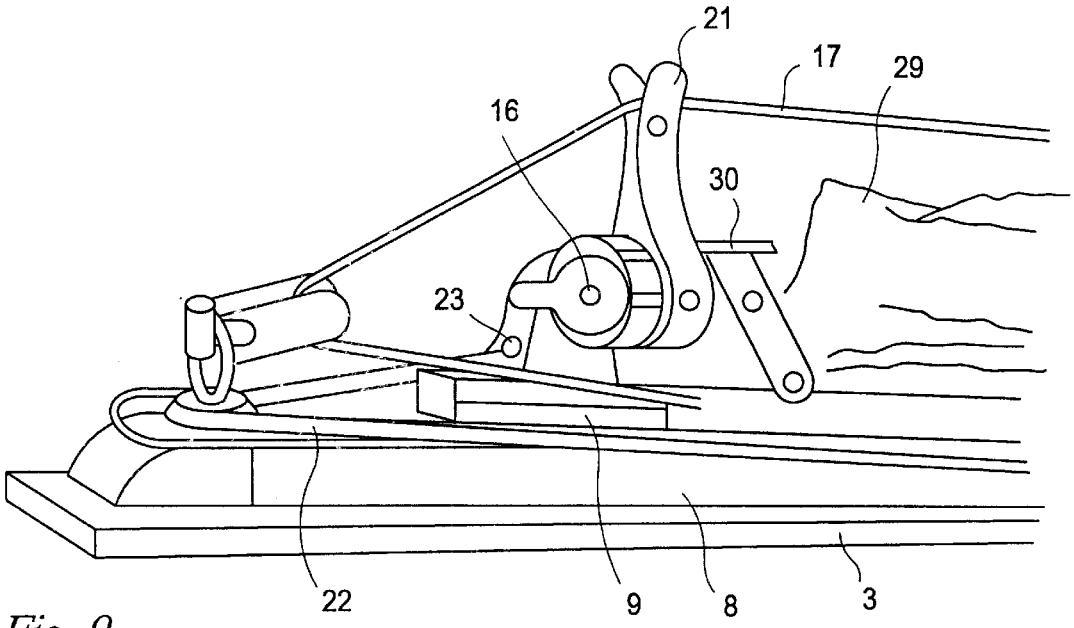
FIG. 9 is a detail perspective view of the forward end of the device with mast down.
Figure 10:
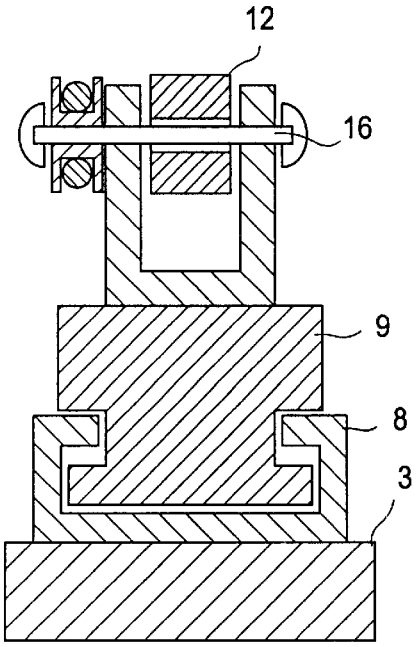
FIG. 10 is a sectional view taken through line 10—10 of FIG. 7.

Referring now to FIGS. 7, 8, and 10, the guideway 8 may be an elongate track as shown, and guideway follower or rider 9 may be so constructed as to slide freely for translation along the centerline, while being securely held to the base.

Other tracks and followers well known in the art may be employed for this purpose, as well.

Figure 11:
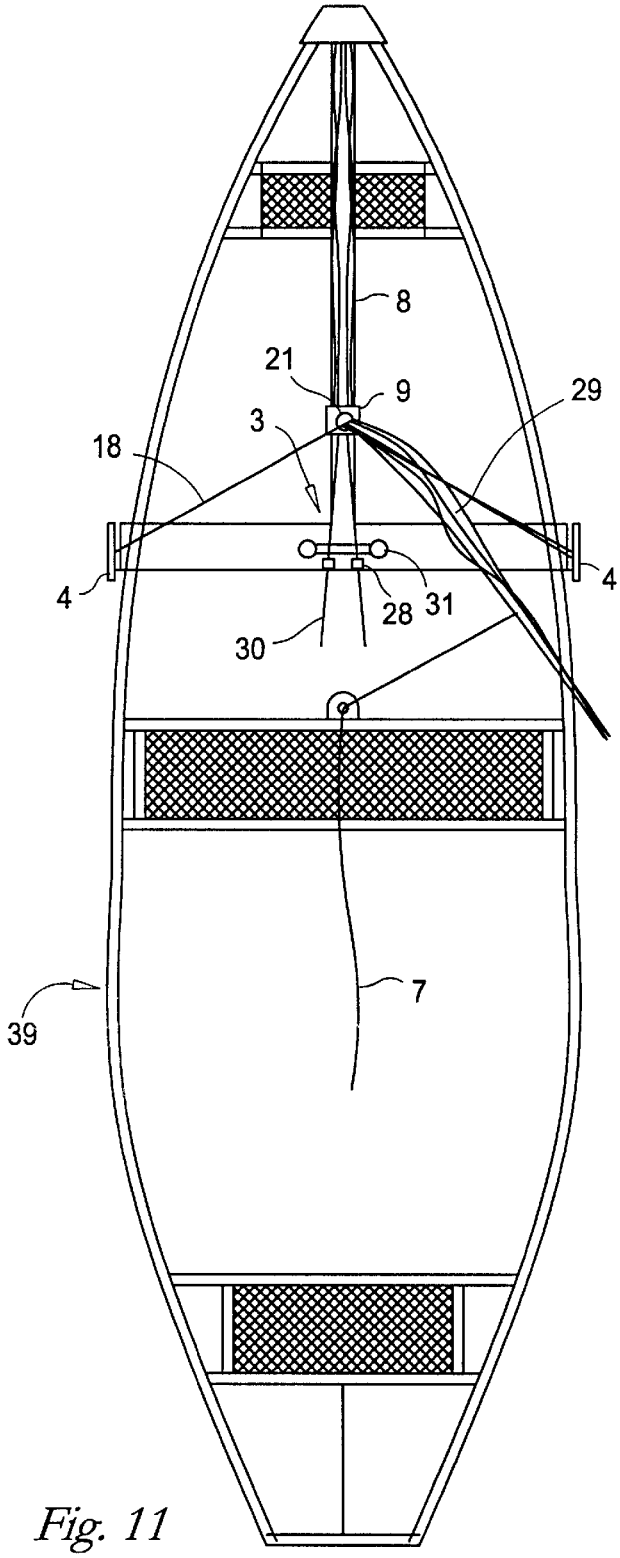
FIG. 11 is a top view, of the device on a canoe, with mast and sail up.

Referring now to FIG. 11, the apparatus of the invention is shown mounted on a canoe 39.

Figure 12:
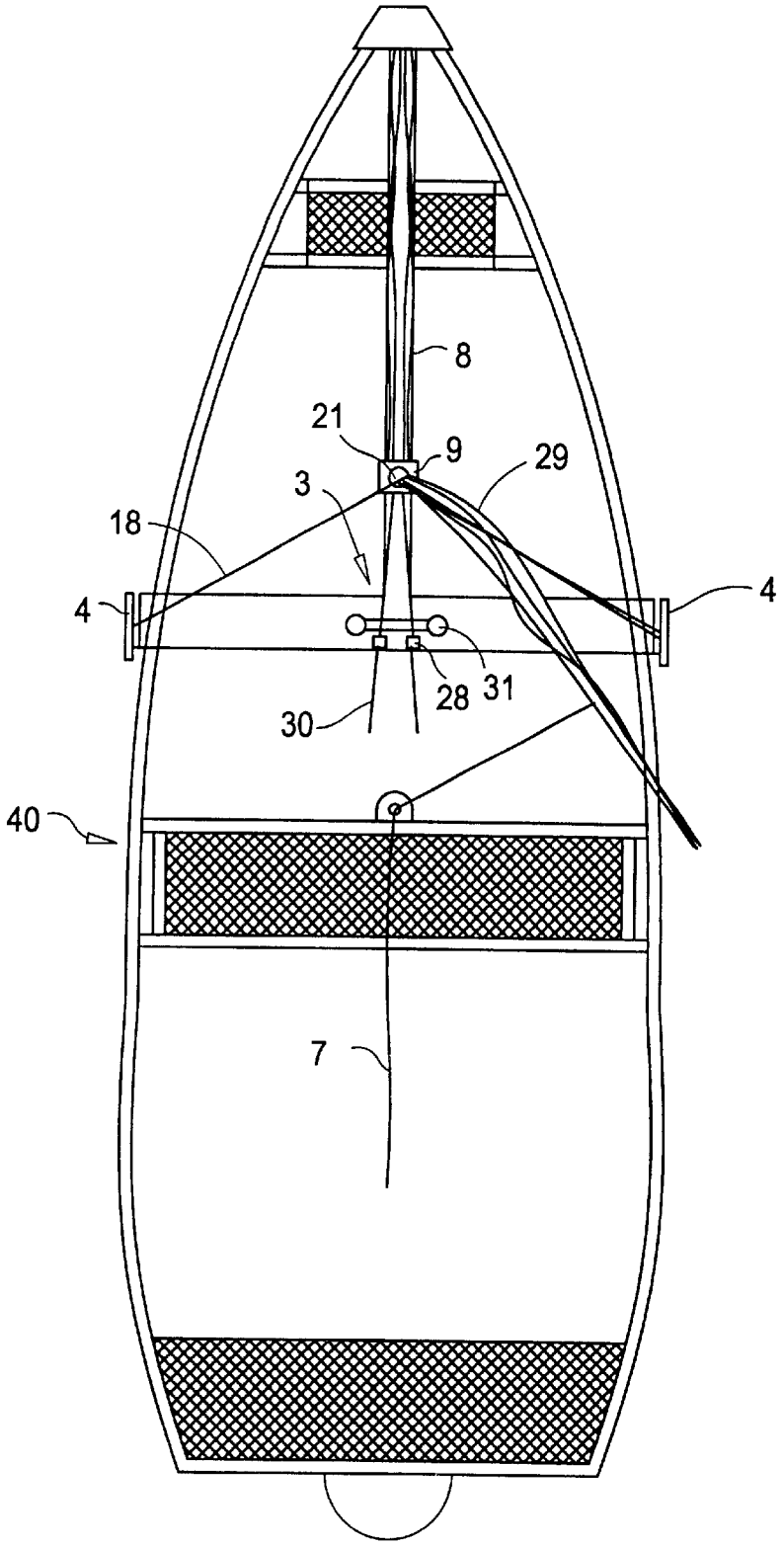
FIG. 12 is a top view as in FIG. 11, of the device on a skiff.

Referring now to FIG. 12, the apparatus of the invention is shown mounted on a skiff 40.

Figure 14:
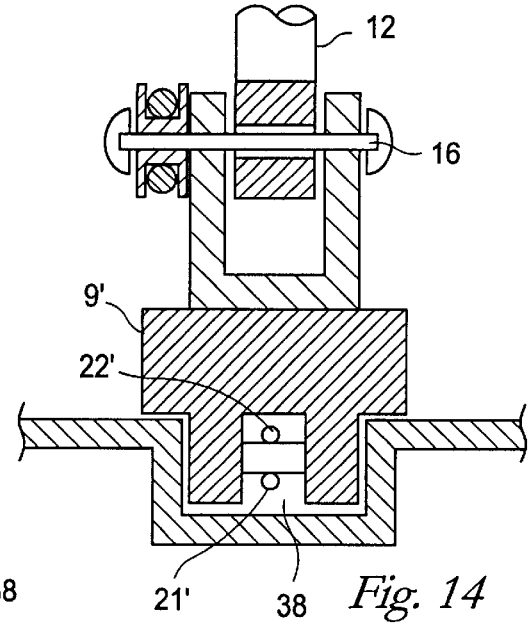
FIG. 14 is a sectional view taken on line 14—14 of FIG. 13.
Figure 13:
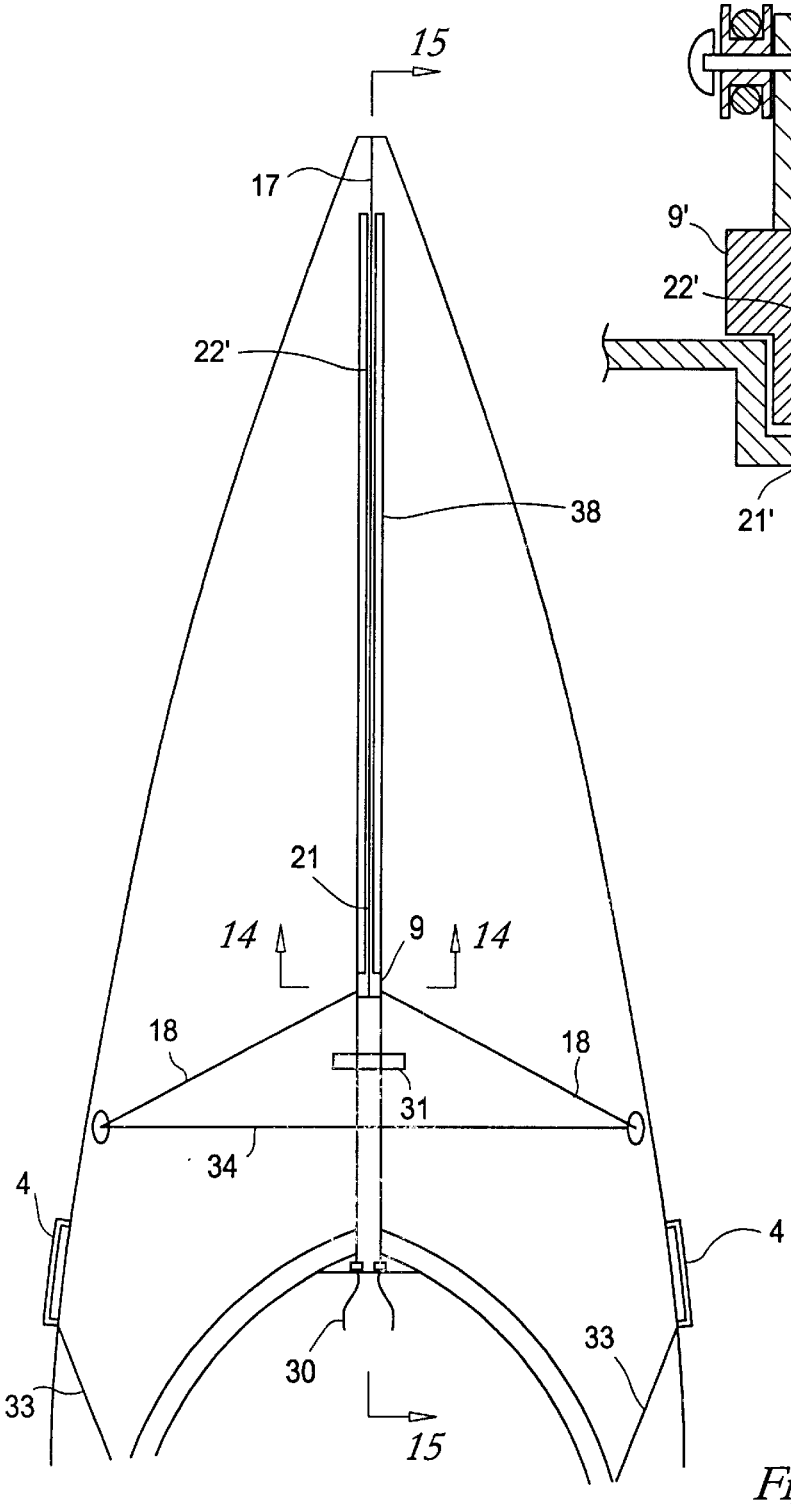
FIG. 13 is a top view, of another embodiment of the invention mounted on a kayak.
Figure 15:
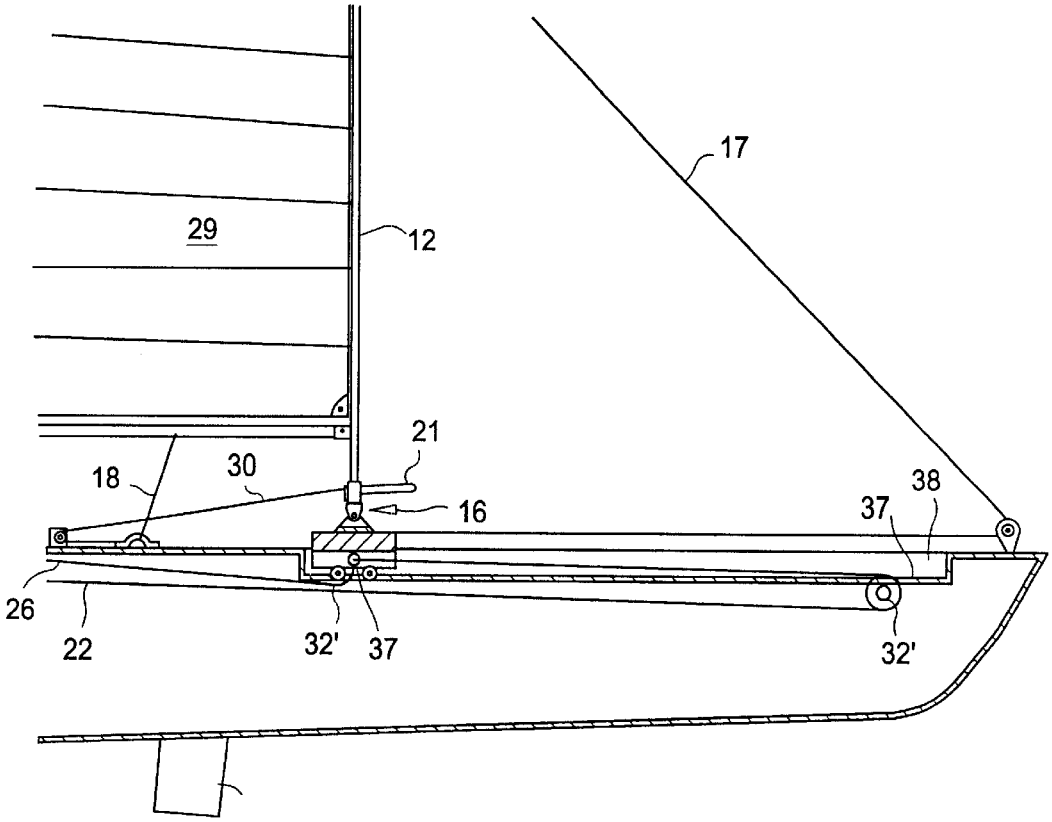
FIG. 15 is a sectional view taken on line 15—15 of FIG. 13.
Figure 16:
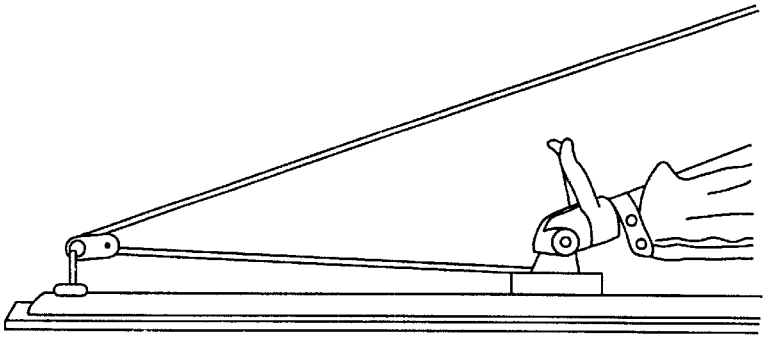
FIG. 16 is a front perspective view as in FIG. 9 with the mast partially erect.

Referring now to FIGS. 13–15, another means for moving the mast to the lowered position is shown. The mast-lowering-means cord 22' attached to the underside of rider 9' and mast deploying cord 21' also attached to the underside of rider 9' pass through fairleads or bushings 37 in the deck and pulleys 32' and then to the boater position from beneath the fore deck so that the rider may be pulled forward by the boater to lower the mast, instead of relying upon a spring or elastic cord. A groove 38 may optionally be molded into the fore deck to serve as a guideway, if desired.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An assembly for enabling a kayak that is normally propelled by a boater paddling from a boating position without an erected mast to be propelled by wind power, the assembly comprising:

a) a base adapted to be mounted on the kayak forward of the boater position;

b) a pair of lee boards connected to the base and adapted to extend down into the water on each side thereof in an operative position to resist lateral wind forces and to retract from the down position in an inoperative position;

c) a guideway on the base adapted to extend along a centerline of the kayak;

d) a follower means adapted to be retained by the guideway while enabling translational movement along the guideway between a forward position and an aft position;

e) a mast having an upper portion, and a bottom end pivotally connected to the follower means;

f) a forestay and two side stays having upper ends connected to the upper portion, the forestay having a lower end attached to the base forward of the forward position of the follower means, and the side stays having lower ends attached to the base abaft the aft position of the follower means;

g) a mast lowering means having a first end connected to the follower means and a second end connected to the base by spring bias means for pulling the bottom end to the forward position, in which the mast is substantially horizontal; and h) a mast deploying cord connected to the follower means operable from the boater position to enable the boater to pull the bottom end of the mast to the aft position against the spring bias means, and to cause the top end of the mast to rise by tension from the forestay; whereby the mast assumes a substantially vertical position supported by the forestay and the side stays.

2. The assembly according to claim 1 further comprising:

a) a sail mounted on the mast; and b) a halyard for raising the sail connected to the sail and adapted to be operable by the boater from the boater position.

3. The assembly according to claim 2 further comprising means for moving the lee boards between operative and inoperative modes from the boater position.

4. The assembly according to claim 2 further comprising spring bias means connected to the forestay and the side stays for maintaining tension thereon when the mast is lowered.

5. The assembly according to claim 4 in which the spring bias means are shock cords.

6. The assembly according to claim 1 in which the guideway is a channel.

7. The assembly according to claim 1 in which elevating means are provided on the mast for elevating the forestay above the mast when the mast is substantially horizontal.

8. The assembly according to claim 7 further comprising:

a) a sail mounted on the mast; and b) a halyard for raising the sail connected to the sail and adapted to be operable by the boater from the boater position.

9. An assembly for enabling a small boat that is normally operated from a boating position without an erected mast, and not propelled by wind, to be optionally propelled by wind power, the assembly comprising:

a) a base adapted for mounting on the boat forward of the boater position;

b) a pair of lee boards connected to the base and adapted to extend down into the water on each side thereof in an operative position to resist lateral wind forces and to retract from the down position in an inoperative position;

c) a guideway on the base adapted to extend along a centerline of the boat;

d) a follower means adapted to be retained by the guideway while enabling translational movement along the guideway between a forward position and an aft position;

e) a mast having an upper portion, and a bottom end pivotally connected to the follower means;

f) a forestay and two side stays having upper ends connected to the upper portion of the mast, the forestay having a lower end attached to the base forward of the forward position of the follower means, and the side stays having lower ends attached to the base abaft the aft position of the follower means;

g) a mast lowering cord having a first end connected to the follower means and a second end operable from the boater position for pulling the bottom end to the forward position, in which the mast is substantially horizontal; and h) a mast deploying cord connected to the follower means operable from the boater position to enable the boater to pull the bottom end to the aft position, and to cause the top end of the mast to rise by tension from the forestay; whereby the mast assumes a substantially vertical position supported by the forestay and the side stays.

10. The assembly according to claim 9 further comprising means for moving the lee boards between operative and inoperative modes from the boater position.

11. The assembly according to claim 9 adapted for use with a kayak.

12. The assembly according to claim 9 adapted for use with a canoe.

13. The assembly according to claim 9 adapted for use with a skiff.

14. The assembly according to claim 9 in which the guideway is a channel.

15. The assembly according to claim 9 further comprising spring bias means connected to the forestay and the side stays for maintaining tension thereon when the mast is lowered.

16. The assembly according to claim 15 in which the spring bias means are shock cords.

17. The assembly according to claim 9 in which the base is adapted to be removably mounted on the boat.

18. The assembly according to claim 9 in which elevating means are provided on the mast for elevating the forestay above the mast when the mast is substantially horizontal.

19. An apparatus for enabling a small boat that is normally operated from a boating position without an erected mast, and not propelled by wind, to be optionally propelled by wind power, the apparatus comprising:

a) a pair of lee boards on the boat adapted to extend down into the water on each side thereof to resist lateral wind forces in an operative position and to retract from the down position in an inoperative position;

b) lee-board-control-means operable from the boater position for moving the lee boards between the operative and inoperative modes;

c) a mast having a mast head, an upper portion, and a bottom end;

d) mast-erecting-and-lowering means connected to the bottom end of the mast and operable from the boater position for moving the bottom end of the mast forward while lowering the mast to a substantially horizontal inoperative mode, and for moving the bottom of the mast aft while erecting the mast to a substantially vertical operative mode; and e) a forestay and two side stays having upper ends connected to the upper portion of the mast, the forestay having a lower end connected to the boat forward of the most forward position of the mast, and the side stays having lower ends attached to a base abaft the most aft position of the bottom of the mast.

* * * * *